US010654087B2

(12) United States Patent
Wahtuse

(10) Patent No.: US 10,654,087 B2
(45) Date of Patent: May 19, 2020

(54) STEELPAN MUSICAL INSTRUMENT HYDROFORMING PRESS

(71) Applicant: Jomo Wahtuse, Chaguanas (TT)

(72) Inventor: Jomo Wahtuse, Chaguanas (TT)

( * ) Notice: Subject to any disclaimer, the term of this patent is extended or adjusted under 35 U.S.C. 154(b) by 0 days.

(21) Appl. No.: 16/486,465

(22) PCT Filed: Sep. 27, 2017

(86) PCT No.: PCT/IB2017/055922
§ 371 (c)(1),
(2) Date: Aug. 15, 2019

(87) PCT Pub. No.: WO2019/064051
PCT Pub. Date: Apr. 4, 2019

(65) Prior Publication Data
US 2020/0001343 A1 Jan. 2, 2020

(51) Int. Cl.

| | |
|---|---|
| ***B21D 26/00*** | (2006.01) |
| ***B21D 26/025*** | (2011.01) |
| ***B21D 26/031*** | (2011.01) |
| ***B21D 26/029*** | (2011.01) |
| ***G10D 13/08*** | (2020.01) |

(52) U.S. Cl.
CPC ..... *B21D 26/025* (2013.01); *B21D 26/029* (2013.01); *B21D 26/031* (2013.01); *G10D 13/08* (2013.01)

(58) Field of Classification Search
CPC .. B21D 26/021; B21D 26/023; B21D 26/031; B21D 26/025; B21D 37/02
See application file for complete search history.

(56) References Cited

U.S. PATENT DOCUMENTS 5,085,068 A 2/1992 Rhoades et al.
6,212,772 B1 4/2001 Whitmyre et al.
(Continued)

FOREIGN PATENT DOCUMENTS

FR 2612431 A1 * 9/1988 ..... B21D 37/02
KR 10-1621239 5/2016

OTHER PUBLICATIONS

International Patent Application No. PCT/IB2017/055922, Invitation to Pay Additional Search Fees, and, Where Applicable, Protest Fee, dated Mar. 12, 2018.
(Continued)

*Primary Examiner* — Debra M Sullivan
(74) *Attorney, Agent, or Firm* — Kilpatrick Townsend & Stockton LLP

(57) ABSTRACT

A machine can form a work piece into a bowl subcomponent of a steel pan musical instrument. The machine includes a pressure lid and a die mold. The die mold may be formed of non-metal layers stacked between metal layers. In example operation, a blank or work piece is inserted between the lid and die mold. The lid is pressed down (e.g., by a hydraulic ram), forcing a portion of the blank into a face groove of the die mold for sealing. Pressurized water or other fluid introduced between the lid and the blank exerts pressure on the sealed portion of the blank and stretches the blank to conform to a bowl shape of the die mold. Note regions can be introduced by this machine-performed shaping and/or by subsequent manual operations to further prepare the work piece for incorporation into a steel pan musical instrument.

14 Claims, 13 Drawing Sheets

(56) References Cited

U.S. PATENT DOCUMENTS

| | | | |
|---|---|---|---|
| 2007/0018356 | A1 | 1/2007 | Nakamura et al. |
| 2009/0178537 | A1 | 7/2009 | Kerns et al. |

OTHER PUBLICATIONS

International Patent Application No. PCT/IB2017/055922, International Search Report and Written Opinion, dated May 8, 2018.
Maloney, S "Acoustics and Manufacture of Caribbean Steelpans"; Dissertation; Publication [online]. Dec. 2010 [retrieved Apr. 23, 2018]. Retrieved from the Internet; <URL: https://www.repository.cam.ac.uk/bitstream/handle/1810/238665/Soren%20E%20Maloney% 202010%20PhD%20thesis.pdf?sequence=1>; pp. 17-18.

* cited by examiner

STEELPAN MUSICAL INSTRUMENT HYDROFORMING PRESS

TECHNICAL FIELD

The present disclosure relates generally to manufacturing processes for producing a steelpan musical instrument and, more particularly (although not necessarily exclusively), to a hydroforming press machine for shaping a work piece for use in a steelpan musical instrument.

BACKGROUND

The national musical instrument of Trinidad and Tobago is the steelpan musical instrument. It can be referred to by a variety of terms, such as "steelpan," "pan," "steel drum," "steel band," or "steel orchestra." The origins of the steelpan are generally traced back to the early part of the World War II around 1939 in Trinidad and Tobago and are often considered a product of chance and circumstance more than anything else.

What started as the hammering out of a few notes on biscuit tins, dustbin lids, and empty caustic soda drums eventually gave way to hammering out of notes in the 55 gallon steel drums that led to the "steel drum" namesake. This took much hammering of the metal and investment of many hours by the creators and early pioneers of what is now familiar as the steelpan instrument.

Traditionally, the initial sinking of a convex shape in constructing the steelpan instrument continues to be a laborious and delicate operation involving much careful hammering. The process tends to be fraught with uncertainty and can quickly turn catastrophic in terms of lost or wasted hours of labor should the metal develop a crack at any period during the process. Given the wide and generally unknown variation in metal composition of the recycled 55 gallon drums commonly used as the starting piece for a steelpan instrument, additional unpredictability is introduced into the process, and the failure rate becomes a concern. Moreover, there can often be a latent safety risk of using recycled drums. For example, the instrument maker can receive a drum still having remnants of chemicals, which can be unknown or can remain even after a thorough cleaning.

Thus, although traditional methods of fabricating steelpan instruments have for generations produced instruments beloved by many, such traditional fabrication techniques can be subject to significant uncertainty, inefficiency, and/or health risks for the instrument makers.

BRIEF SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

Various aspects described herein relate to devices, methods, and/or other features that can be implemented for improving the manufacturing process of the steelpan instrument. For example, in various situations, the fabrication of a steelpan instrument can be improved by supplying a maker or tuner of the steel pan instrument with a blank that has already been concaved. In such instances, the tuner's role can be focused on marking the notes and final tuning, rather than also investing time producing the initially concaved shape for the blank. A pre-formed blank can also be of a known thickness and consistency, which can drastically improve predictability for the tuner and reduce trial and error of finding a sweet spot of the steel to produce the desired notes. Moreover, health concerns related to toxic chemical residue can be obviated by providing a blank formed from material from a known clean source rather than from an unknown, potentially contaminated source. Various aspects described herein relate to a press or machine that can be utilized to sink a drum for a steelpan instrument in a short amount of time, such as 45 minutes, which can be a significant time savings in comparison to the 8 hours that might often be expected using traditional techniques. In addition to a faster overall turnaround time for producing the instrument when no errors are committed, use of a machine can reduce turnaround time when errors are committed. For example, even if the tuner happens to render a machine-formed pan defective, this can correspond to less than an hour of work being wasted in contrast to a full day's work being lost if the pan were instead to be initially formed by hammering by hand.

Various aspects and examples of the present disclosure are directed to apparatuses or machines for forming a work piece into a bowl subcomponent of a steel pan musical instrument. In one example, one such machine includes a pressure lid, a mold die, and a fluid passage. The mold die can be configured to receive the work piece between the mold die and the pressure lid. The mold die can include a bowl profile; a base plate including metal material; a cap plate including metal material; and at least one spacer plate including non-metal material. The spacer plate (or plates) can be positioned between the base plate and the cap plate so as to form a stacked assembly that defines the bowl profile. The fluid passage can be configured to couple with a source of pressurized fluid and arranged to introduce the pressurized fluid between the pressure lid and the work piece to exert a fluid pressure on the work piece for hydroforming in response to which the work piece is pressed against the bowl profile to be formed into the bowl subcomponent of the steel pan musical instrument.

Various aspects and examples of the present disclosure are directed to processes for use in making a steelpan musical instrument. In one example, one such method includes providing a metal sheet as a work piece from which to form at least a portion of the steel pan instrument, hydroforming the work piece into a bowl shape, and forming at least one note region in the work piece by hand hammering the note region (or regions) for the steel pan musical instrument. The method may further include coupling a skirt with the work piece. Additionally or alternatively, the method may include hydroforming the work piece into a bowl shape by hydroforming the work piece against a mold die that includes a bowl profile; a base plate including metal material; a cap plate including metal material; and at least one spacer plate including non-metal material, where the at least one spacer plate is positioned between the base plate and the cap plate so as to form a stacked assembly that defines the howl profile.

In another example, a method of forming a steel pan musical instrument more specifically includes providing (A) a metal sheet as a work piece from which to form at least a portion of the steel pan instrument, and (B) a pressure lid including (i) a press collar, (ii) a fluid passage extending through the pressure lid, (iii) a guide shaft extending from an underside of the pressure lid, and (iv) a groove formed in the underside of the pressure lid. The method also includes coupling the press collar of the pressure lid with a hydraulic press and coupling the fluid passage of the pressure lid to a source of pressurized fluid. The method also includes installing a ring in the groove of the pressure lid and installing a forming die onto the pressure lid by engaging the forming die with the ring. The forming die can include (i) a main body having a partial dome shape and (ii) an outlet extending through the main body and in fluid communication with the fluid passage of the pressure lid when the forming die is installed on the pressure lid. The method also includes providing a mold die including (i) a face groove in an upper side, (ii) a bowl profile recessed from the upper side and positioned radially inward from the face groove, and (iii) a guide passage configured to receive the guide shaft of the pressure lid. The mold die can be provided by providing a base plate of the mold die assembly; providing at least one spacer plate of the mold die assembly; providing a cap plate of the mold die assembly; positioning the base plate, the at least one spacer plate, and the cap plate together into a stack such that the at least one spacer plate is positioned between the base plate and the cap plate; and coupling the base plate, the at least one spacer plate, and the cap plate together by extending rods through the stack and securing the rods to secure the stack together. The method also includes placing the work piece on the mold die, placing a diaphragm on the work piece, and aligning the guide shaft of the pressure lid to travel within the guide passage of the mold die so as to maintain an alignment between the pressure lid and the mold die during movement of the pressure lid relative to the mold die. The method also includes operating the hydraulic press to push the pressure lid toward the mold die so that the forming die coupled with the pressure lid engages the diaphragm for pressing the work piece into sealing engagement with the face groove of the mold die and for imparting a shape of the forming die into the work piece. The method also includes hydroforming the work piece, where the hydroforming includes: introducing pressurized fluid through the fluid passage of the pressure lid and the outlet of the forming die to the diaphragm so as to exert fluid pressure through the diaphragm to the work piece, and, in response to the fluid pressure exerted through the diaphragm to the work piece, causing the work piece to be pressed against the bowl profile of the mold die to form the work piece into a corresponding bowl shape. The method also includes operating the hydraulic press to separate the lid from the mold die and removing the work piece in the form of a bowl for incorporation into the steel pan musical instrument.

For a fuller understanding of the nature and advantages of the present invention, reference should be made to the ensuing detailed description and accompanying drawings.

BRIEF DESCRIPTION OF THE DRAWINGS

Various embodiments in accordance with the present disclosure will be described with reference to the drawings, in which.

DETAILED DESCRIPTION

In the following description, various embodiments will be described. For purposes of explanation, specific configurations and details are set forth in order to provide a thorough understanding of the embodiments. However, it will also be apparent to one skilled in the art that the embodiments can be practiced without the specific details. Furthermore, well-known features can be omitted or simplified in order not to obscure the embodiment being described.

The specification and drawings are, accordingly, to be regarded in an illustrative rather than a restrictive sense. It will, however, be evident that various modifications and changes can be made thereunto without departing from the broader spirit and scope of the disclosure as set forth in the claims.

Figure 1:
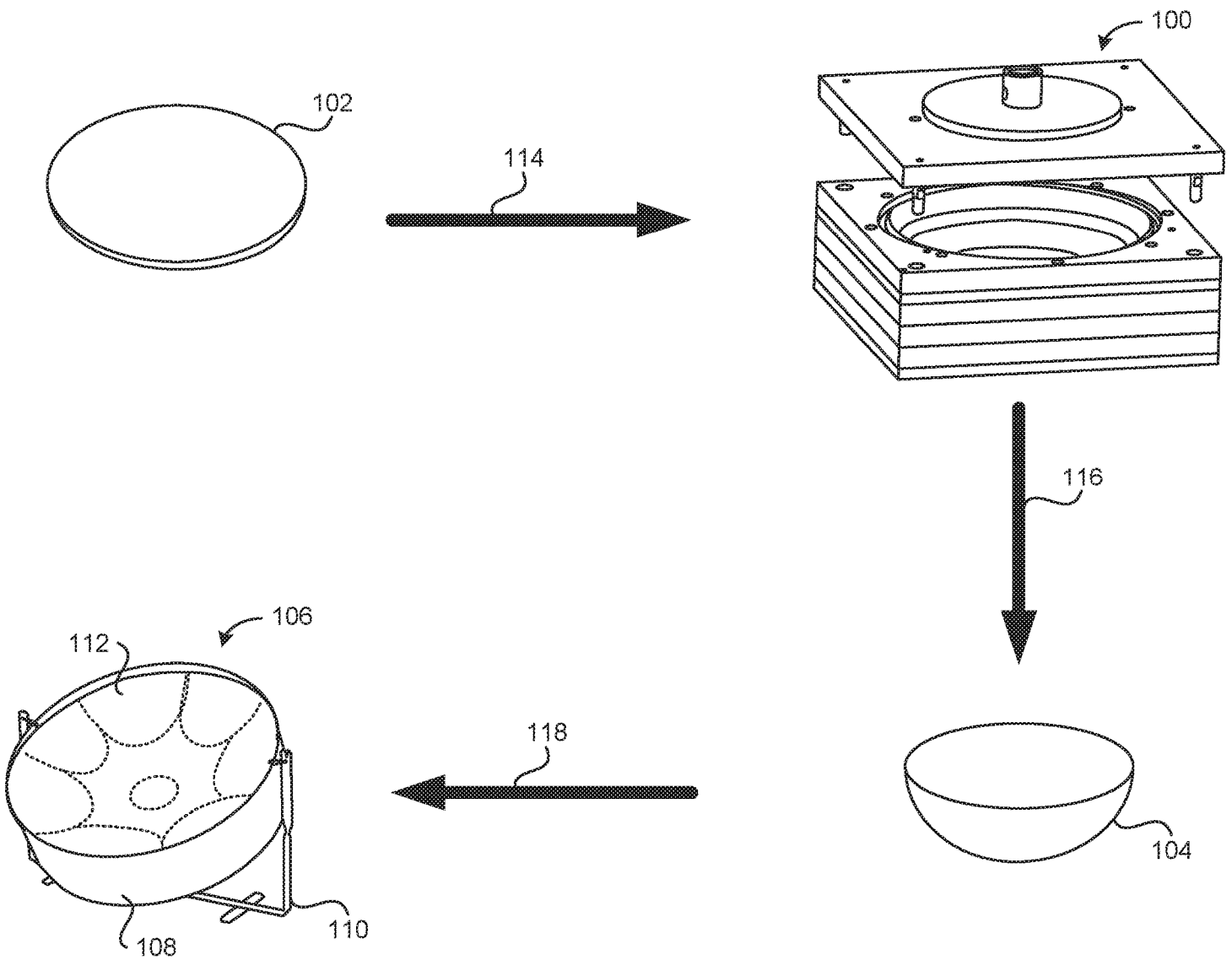
FIG. 1 illustrates a process for fabricating a steel pan instrument via a hydroforming machine according to various aspects.

Referring now to the drawings, in which like reference numerals refer to like elements, FIG. 1 illustrates a process for fabricating a steel pan instrument 106 via a hydroforming machine 100 according to certain aspects. As illustrated at arrow 114, a blank 102 is loaded into the machine 100. The blank 102 shown in FIG. 1 is flat and round, although other form factors may be utilized. For example, in some embodiments, the machine 100 may operate on a dimpled or otherwise non-flat blank 102 (e.g., smoothing it out during operation of the machine 100). As a further example, in some embodiments, a square or other shape of blank 102 may be introduced into the machine 100 and excess portions of the shape can be trimmed at a later stage as appropriate. The blank 102 can be of any suitable material for a steel pan instrument. For example, the material can be hand selected or otherwise carefully chosen from a known composition, which can contrast with more traditional forms of fabricating steel pan instruments that rely on discarded and/or otherwise repurposed steel drums, which often have an unknown composition.

As illustrated by arrow 116, operation of the machine 100 hydroforms the blank 102 into a bowl 104 that can be a sub-component to be used for incorporating into a steel pan instrument, such as the steel pan instrument 106. In some aspects, use of the machine 100 can significantly reduce an amount of time and/or chance of inadvertent errors in creating a bowl for a steel pan instrument. For example, traditionally, as described above, a bowl for a steel pan can be hammered out of an end of a steel drum and can entail many hours (e.g., two to four) of hammering to obtain the bowl. Moreover, the hammering process by hand in many cases can be prone to mistakes that can render the bowl unsuitable for incorporation into a steel pan instrument, thus rendering much labor lost. For example, hand-hammering inadvertently with too much force may irreparably rupture or crack the bowl at a particular location, or excessive hand-hammering may render a portion of the bowl too thin or to dented to use in the steel pan musical instrument. In contrast, use of the machine 100 in some examples can allow a bowl 104 to be reproduced in a matter of 45 minutes or less and can provide a reliable fabrication process that reduces risk of labor losses from hand worked errors in fabrication. For example, the machine 100 may evenly distribute pressure to make the bowl a uniform thickness and/or avoid problems from concentrated stresses from the sharp blows of a hammer.

As illustrated at arrow 118, suitable operations can be conducted relative to the bowl 104 to fabricate the bowl 104 into a steel pan instrument 106. In some aspects, such subsequent operations can include "tuning" the bowl. For example, a laborer can hand-hammer in specific note regions 112 according to preference and design to provide distinct areas of the instrument 106 that will produce different tones when struck while being played by a musician. In some aspects, the note regions can be automatically introduced by operation of the machine rather than or in addition to being a post-processing manual operation. Other post-processing operations can include attaching the bowl 104 to a skirt 108 and/or mounting the bowl 104 on a stand 110. In some examples, coupling the skirt 108 with the bowl 104 can include welding the two components together. However, the skirt can be formed of any suitable material. Thus, although in some aspects the skirt can be metal and facilitate welding to a metal bowl 104, in other aspects, other materials (such as, but not limited to, wood, plastic, rubber, metal, non-metal materials, and/or other suitable materials) can be utilized for the skirt 108 and coupled with the bowl 104 in any suitable manner (such as via fasteners, adhesives, or other coupling methods). Similarly, the stand 110 can be metal or any other suitable material and can include suitable structure for supporting the bowl 104 and other associated components of the steel pan instrument 106 during and/or upon completion of fabrication. For example, the stand 110 can be used in positioning the note regions 112 or other elements of the steel pan instrument 106 at a conveniently accessible location for a musician during use.

Figure 2:
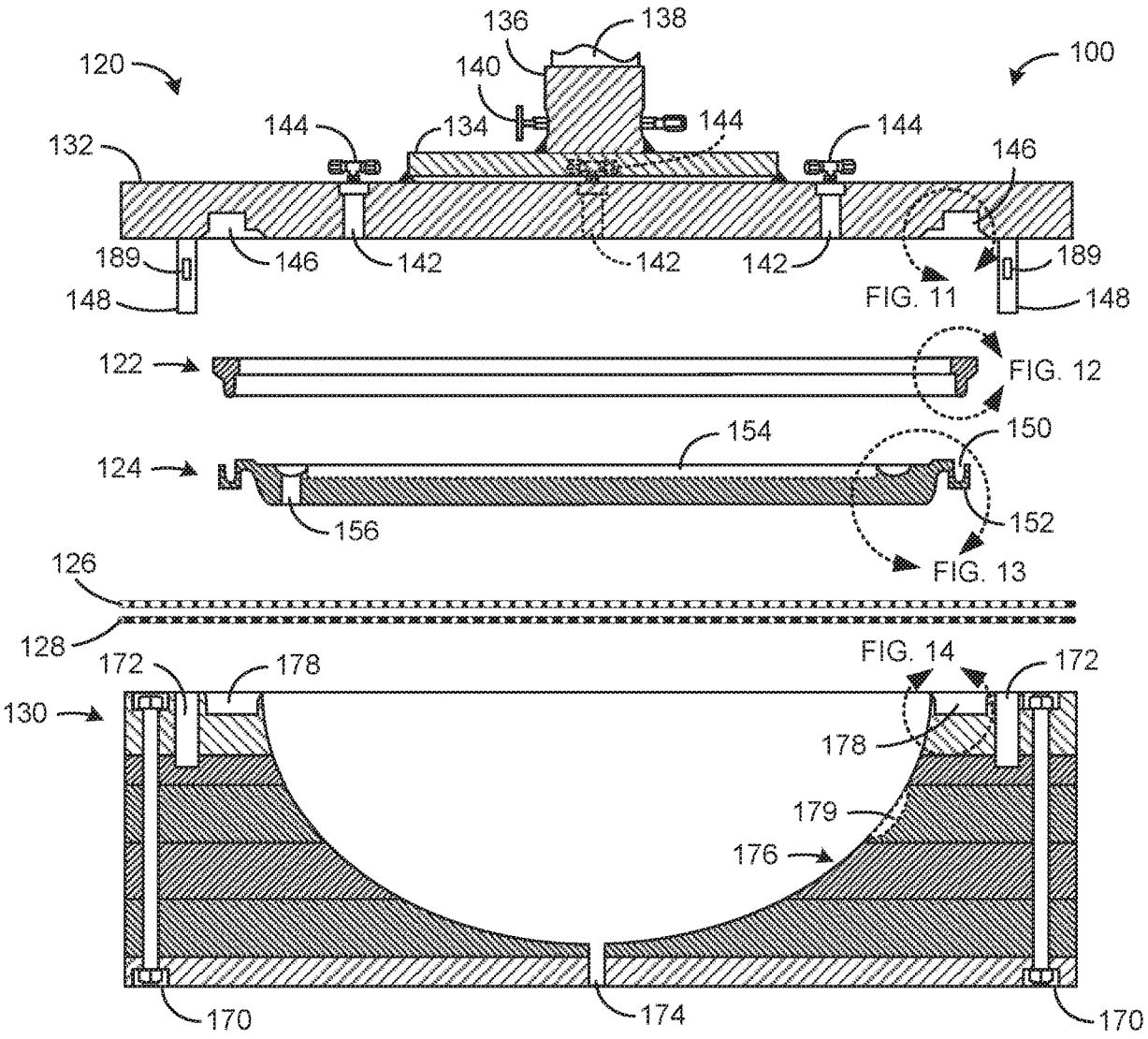
FIG. 2 illustrates an exploded assembly side view of the machine according to various aspects.

FIG. 2 illustrates an exploded assembly side view of the machine 100 according to certain aspects. The arrangement shown in FIG. 2 includes a pressure lid 120, a forming ring 122, a forming die 124, a rubber sheet or other suitable flexible barrier (hereinafter diaphragm 126), a work piece 128, and a mold die assembly 130. Generally the pressure lid 120 can include and/or interface with appropriate features (such as the diaphragm 126, the forming ring 122, and/or the forming die 124) for pressing the work piece 128 into the mold die assembly 130 with sufficient pressure to cause the work piece 128 to conform to the mold die assembly 130, e.g., to form the work piece 128 into a bowl shape, such as can be utilized for a steel pan instrument 106.

In various aspects, the pressure lid 120 and associated features provide a structure in which water or other fluid can be introduced to provide pressure for forming the work piece 128 into a suitable shape in the fabrication process. The particular features depicted in FIG. 2 and subsequent figures will now be described in greater detail, although it is to be understood that certain features can be combined, eliminated, modified, or otherwise varied from the forms specifically depicted, and certain examples of such variations will be described in the course of discussing the depicted features.

The illustrated pressure lid 120 in FIG. 2 includes a lid plate 132, a collar plate 134, a press collar 136 (e.g., which can receive a ram of a hydraulic press secured by a coupling pin 140 or other suitable fastening device), fluid ports 142, fittings 144, a groove 146, and guide shafts 148.

In operation, the fittings 144 can be coupled with appropriate lines (e.g., tubes or hoses) in fluid communication with a pump or other pressure-raising component for introducing fluid pressure through the fittings 144. Fluid pressure introduced through the fittings 144 can be communicated through the fluid ports 142 of the pressure lid 120 to provide fluid pressure for pressing the work piece 128 into the mold die assembly 130 so that the work piece 128 deforms to match the shape of the mold die assembly 130.

The press collar 136 can receive a ram 138 of a hydraulic press in order to exert a force against the pressure lid 120 that is sufficient to withstand pressure from an opposite side of the lid 120 that can be exerted during the fabrication process. For example, in operation, the ram 138 of the hydraulic press can press against a top of the pressure lid 120 to maintain the pressure lid 120 in a closed or sealed position and counteract hydraulic forces exerted on a bottom side of the pressure lid 120 that urge the pressure lid 120 toward an open or unsealed position. In some aspects, in lieu of a hydraulic press acting on the pressure lid 120 through the press collar 136, the pressure lid 120 can be secured to the mold die assembly 130 with latches or other mechanisms capable of securing the pressure lid 120 to the mold die assembly 130 sufficiently tightly to withstand pressure build-up between the pressure lid 120 and the mold die assembly 130.

In FIG. 2, the press collar 136 is shown welded to the collar plate 134, which is in turn shown welded to the lid plate 132. However, any other joining method or mechanism can additionally or alternatively be used. In some aspects, the collar plate 134 acts as a load distribution plate and distributes a load from the ram 138 of the hydraulic press over an extended surface area of the lid plate 132. Moreover, although the lid plate 132, the collar plate 134, and the press collar 136 can, in some examples, be formed of steel or another metal (e.g., to facilitate welding) other materials can additionally or alternatively be utilized.

Figure 15:
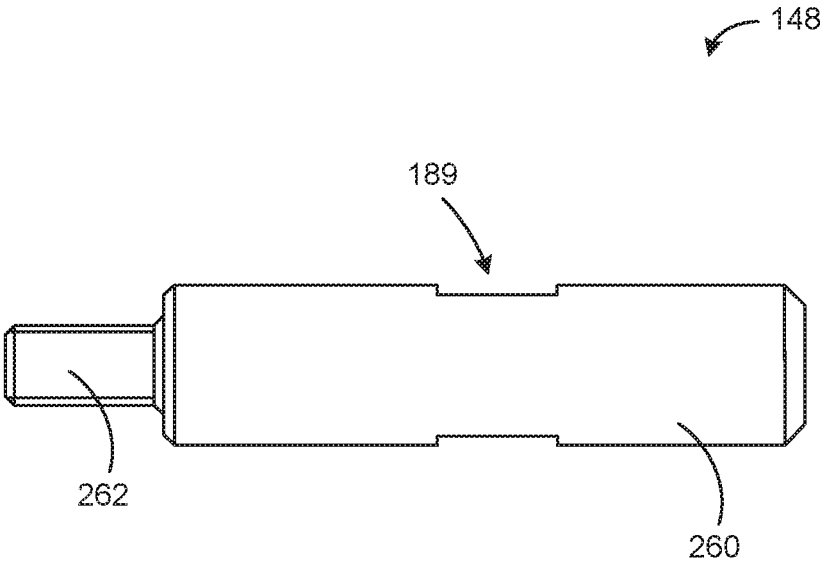
FIG. 15 is a detail view showing an example in isolation of the guide shaft shown in FIG. 2 according to various aspects.

The guide shafts 148 shown in FIG. 2 are received in a bottom surface of the lid plate 132. The guide shafts 148 can align the pressure lid 120 with the mold die assembly 130. FIG. 15 illustrates an example of a guide shaft 148 in isolation according to certain aspects. In some aspects, the guide shafts 148 are threaded on an upper surface or upper end 262 to facilitate being received in the lid plate 132 (FIG. 2). In some aspects, the guide shafts 148 include installation features 189 (e.g., shown as flat surfaces for receiving a wrench for facilitating twisting for installation relative to the pressure lid 120).

The groove 146 shown in FIG. 2 is positioned on an underside of the lid plate 132 and sized to receive other components. An example of a cross-section of the groove 146 is shown in greater detail in FIG. 11. The groove 146 can be circumferentially arranged, for example, as can be appreciated with reference to FIG. 5. Referring again to FIG. 2, the groove 146 can be sized for receiving features of the ring 122 and/or of the forming die 124. For example, in operation, the ring 122 can be coupled with the lid plate 132 by being received in the groove 146. The forming die 124 can be coupled with the lid plate 132 via the ring 122. For example, the forming die 124 in FIG. 2 includes a protrusion 152 and a coupling groove 150. The coupling groove 150 can be sized to be received on a lower side of the ring 122, for example, to fit with an interference fit that will retain the forming die 124 against the ring 122 as the ring 122 is retained by a press fit in the groove 146 of the lid plate 132. The coupling groove 150 of the forming die 124 can be formed in an upper side of the protrusion 152 of the forming die 124.

The forming die 124 in FIG. 2 is also shown including a channel 154 and outlet 156. The channel 154 can be circumferentially arranged, for example, as can be appreciated with reference to FIGS. 4 and 5. Referring again to FIG. 2, in operation, the channel 154 can receive fluid through the fluid ports 142 in the pressure lid 120 and distribute fluid through the outlet 156. Thus, a fluid path can be arranged from the fittings 144, through the ports 142 in the pressure lid 120, into the channel 154, and out the outlet 156 of the forming die 124.

The diaphragm 126 can be formed of rubber or any other suitable material. The diaphragm 126 can provide a sealing interface that can seal water traveling through the fluid path (e.g., through the pressure lid 120). The diaphragm 126 further can flex in response to pressure from such water or other fluid. Thus, the diaphragm 126 can function to seal water or other fluid and also communicate pressure conveyed by such water or other fluid. In some aspects, the diaphragm is sized so that guide shafts 148 can extend into the mold die assembly without passing through the diaphragm 126. In other aspects, the diaphragm 126 can include through holes to accommodate the guide shafts 148.

The work piece 128 can correspond to the blank 102 of FIG. 1. In the arrangement shown in FIG. 2, the work piece 128 can have the shape of the blank shown in FIG. 1. The work piece 128 is distinguished from the blank 102 in that the work piece 128 may be shown in different stages in the fabrication process in different figures herein and thus can differ from the blank 102 in such figures.

The mold die assembly 130 shown in FIG. 2 includes a curved surface 176 that defines a bowl profile for receiving the work piece 128, e.g., for imparting a bowl shape to the work piece 128 via operation of the machine 100. An indentation 179 is also shown in the curved surface 176 and may be utilized for example for forming a note region 112 for a steel pan instrument 106.

The mold die assembly 130 shown in FIG. 2 further includes guide passages 172, a drain passage 174 (or vent), and a face groove 178. The guide passages 172 can be sized to receive the guide shafts 148. For example, receiving the guide shafts 148 in the guide passages 172 can align the pressure lid 120 with the mold die assembly 130. The drain passage 174 may allow air, water, or other fluid to escape through the mold die assembly during operation of the machine.

The face groove 178 can facilitate sealing during operation of the machine 100. For example, the face groove 178 may function to receive a portion of the work piece 128 (e.g., in response to pressure from the ring 122 and/or forming die 124), which can form a seal that can prevent passage of pressurized fluid away from the work piece 128 during operation of the machine 100. Example operation relative to the face groove 178 is described in greater detail below beginning with reference to FIG. 6. The face groove 178 can be circumferentially arranged, e.g., which can facilitate engagement of the forming ring 122 and/or the protrusion 152 of the forming die 124 into the face groove 178. The bowl profile formed by the curved surface 176 can be positioned radially inward from the face groove 178.

Figure 3:
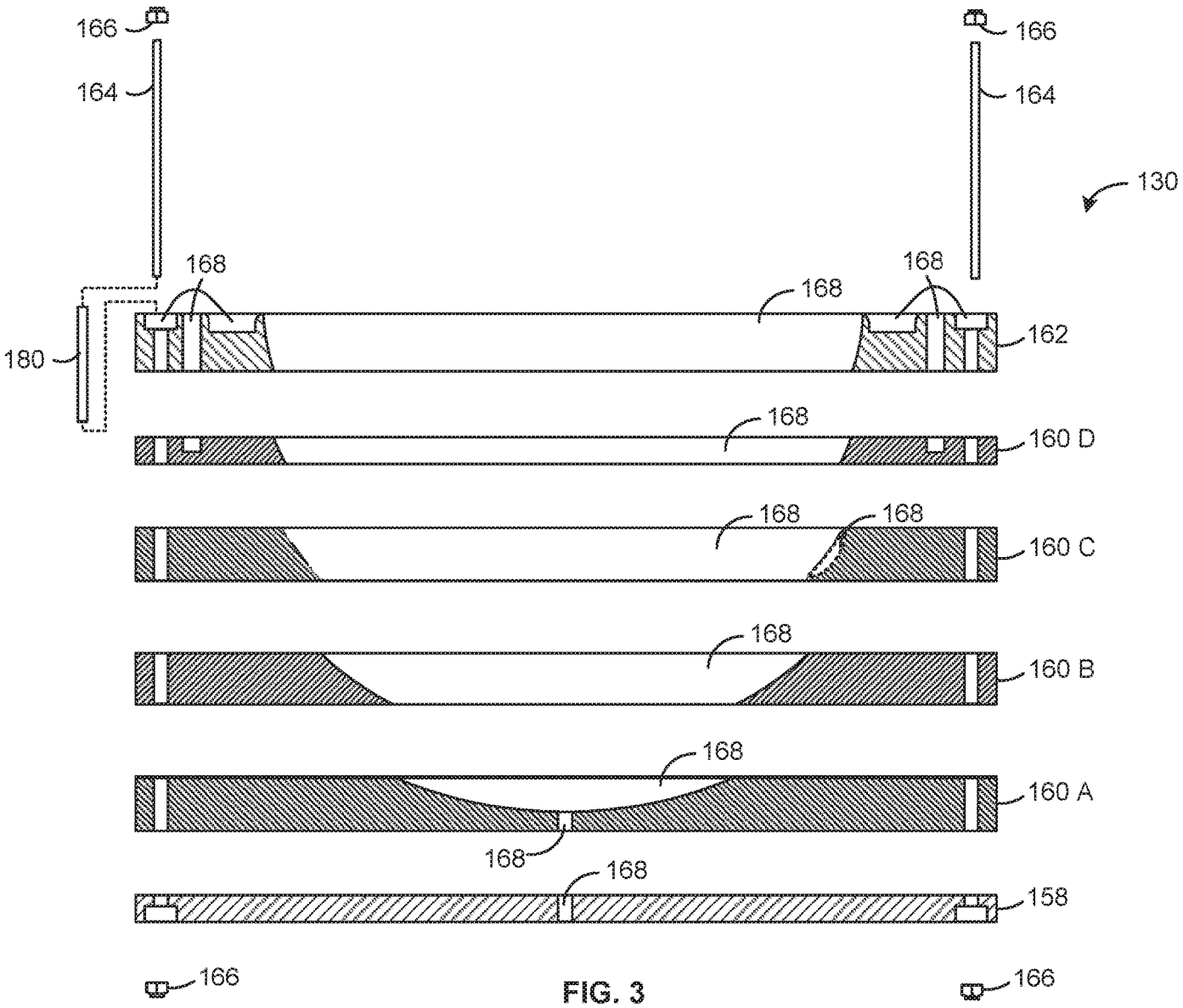
FIG. 3 illustrates an exploded assembly view of a mold die assembly of the machine according to various aspects.

FIG. 3 illustrates an exploded assembly view of the mold die assembly 130. In the arrangement shown in FIGS. 2-3, the mold die assembly 130 is illustrated as an assembly of layers. However, in some aspects, the mold die assembly can be formed from a single block of material. As an illustrative example, the mold die assembly 130 can be formed by a steel block having openings formed therein to define the features described above with respect to FIG. 2. However, such a construction can result in a significantly heavy mold die assembly 130, for example, which can reduce an ease of portability of the machine 100. In contrast, the layered assembly as shown in FIG. 3 can permit the mold die assembly 130 to be readily disassembled for ease of transport between respective locations at which the machine 100 is to be utilized.

In various examples, the cap plate 162 can be formed of a metal (such as a medium carbon steel or other form of steel) or other suitable material. The base plate 158 can similarly be formed of such a metal (such as a medium carbon steel or other form of steel) or other suitable material. The spacer plates 160 can be formed of polyoxymethylene or other suitable material that is more lightweight than metal. Polyoxymethylene is also known by many other names, including chemical names (such as acetal, polyacetal and polyformaldehyde) and commercial names (such as Delrin®, Celcon®, Ramtal, Duracon®, Kepital®, and Hostaform®). Using a material such as polyoxymethylene (which exhibits a high strength characteristic and/or hardness that can be suitable for such applications) can allow the mold die assembly 130 to be significantly lighter in weight (and therefore more easily transportable or portable) than if the mold die assembly 130 were instead made of a single, unitary, undivided piece. In some aspects, the spacer plates 160 can also be more easily replaced than if an entire mold die assembly 130 were to be refabricated as a unitary piece.

In FIG. 3, the mold die assembly 130 includes a base plate 158, spacer plates 160 (individually identified as 160*a*-160*b*), a cap plate 162, rods 164, fasteners 166, and a sleeve 180. The base plate 158, spacer plates 160, and cap plate 162 are shown in FIG. 3 having openings 168 that define features within the assembled mold die assembly 130 shown in FIG. 2. The openings 168 in some instances extend through a respective plate and extend less than an entire distance through a plate in other instances. For example, rod passages 170 (FIG. 2) can be formed by respective through holes 168 (FIG. 3) extending through each of the base plate 158, spacer plate 160, and cap plate 162 to define a space in which rods 164 can be inserted for securing respective plates of the mold die assembly 130 together.

In some aspects, the rod passages 170 (FIG. 2) can be lined with sleeves 180 (FIG. 3). The sleeves 180 can be formed of material that has a lower hardness than the rods 164 or the plates of the mold die assembly 130. For example, if the rods 164 and plates of the mold die assembly 130 are formed of metal, the sleeve 180 can be formed of brass, polyoxymethylene, or other materials.

Respective ends of the rod passages 170 (FIG. 2) can be counter sunk or otherwise recessed in respective ends of the mold die assembly 130. For example, such recessed features in a top side of the mold die assembly 130 (e.g., in the cap plate 162 in FIG. 3) can receive nuts 166 or other fasteners to secure the rods 164 in position in the rod passages 170 (FIG. 2) and reduce a chance or risk of the rods 164 extending out of the mold die assembly 130 and causing misalignment of the work piece 128 from being flush against a top surface of the mold die assembly 130. Similarly, a bottom side of the mold die assembly 130 (e.g., the base plate 158 in FIG. 3) can include recessed features for receiving nuts 166 or other fasteners to couple the rods 164 in place in the rod passages 170 (FIG. 2) and allow for a flush interface along the bottom of the mold die assembly 130.

Openings 168 (FIG. 3) in respective layers of the mold die assembly 130 can also define guide passages 172 (FIG. 2). The mold die assembly 130 can also include openings 168 (FIG. 3) that define the face groove 178 (FIG. 2). For example, a face groove 178 can be formed in the cap plate 162 (FIG. 3) of the mold die assembly 130.

Any respective layer of the mold die assembly 130 can also include openings 168 (FIG. 3) that define a portion of the bowl profile or curved inner surface 176 (FIG. 2) of the mold die assembly 130. For example, the layers can be machined to provide such a curved surface or contour. In some aspects, the openings 168 (FIG. 3) that define a portion of the bowl profile or curved inner surface 176 (FIG. 2) of the mold die assembly 130 can also define indentations 179, such as may be utilized for forming a note region 112.

Openings 168 (FIG. 3) can also define the drain passage 174 (FIG. 2) or vent when assembled. For example, the vent 174 shown in FIG. 2 extending through the bottom of the mold die assembly 130 can correspond to respective openings shown in FIG. 3 in the base plate 158 and the first spacer plate 160*a*.

Figure 4:
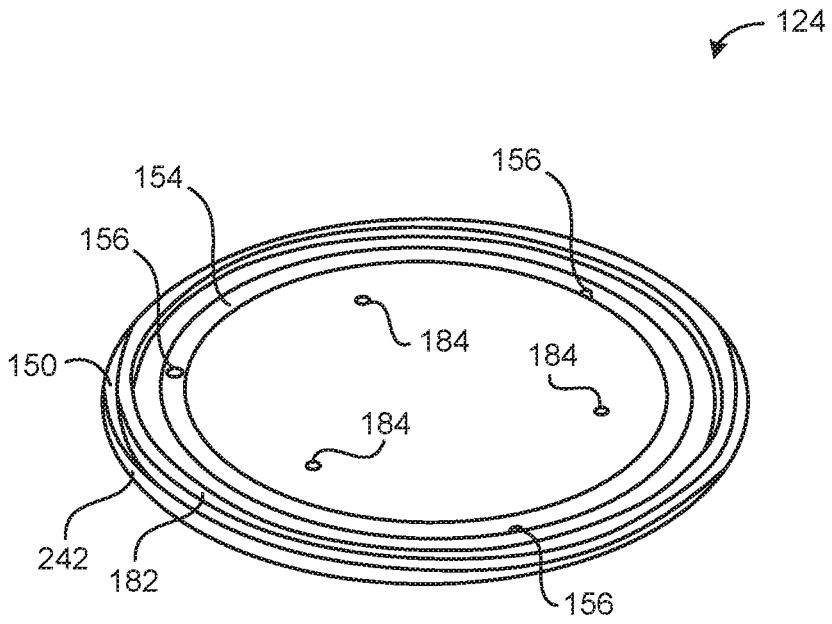
FIG. 4 illustrates a top perspective view of the forming die according to various aspects.

FIG. 4 illustrates a top perspective view of the forming die 124 in isolation. In FIG. 4, the channel 154 is shown in communication with three outlets 156, although only one outlet 156 is visible in the cross-sectional view of FIG. 2. Nevertheless, one, two, three, or any other suitable number of outlets 156 can be included in the channel 154. Including multiple outlets 156 along the channel 154 can permit fluid to travel at various points through the forming die 124 and thus spread out a distribution of fluid pressure.

In FIG. 4, the forming die 124 is also shown including fastener apertures 184. In some aspects, the fastener apertures 184 can be utilized to permit fasteners to be inserted through the forming die 124 to secure the forming die 124 to an underside of the pressure lid 120, e.g., in addition to or in lieu of attaching the forming die 124 by engagement with the forming ring 122 and/or the groove 146.

Figure 5:
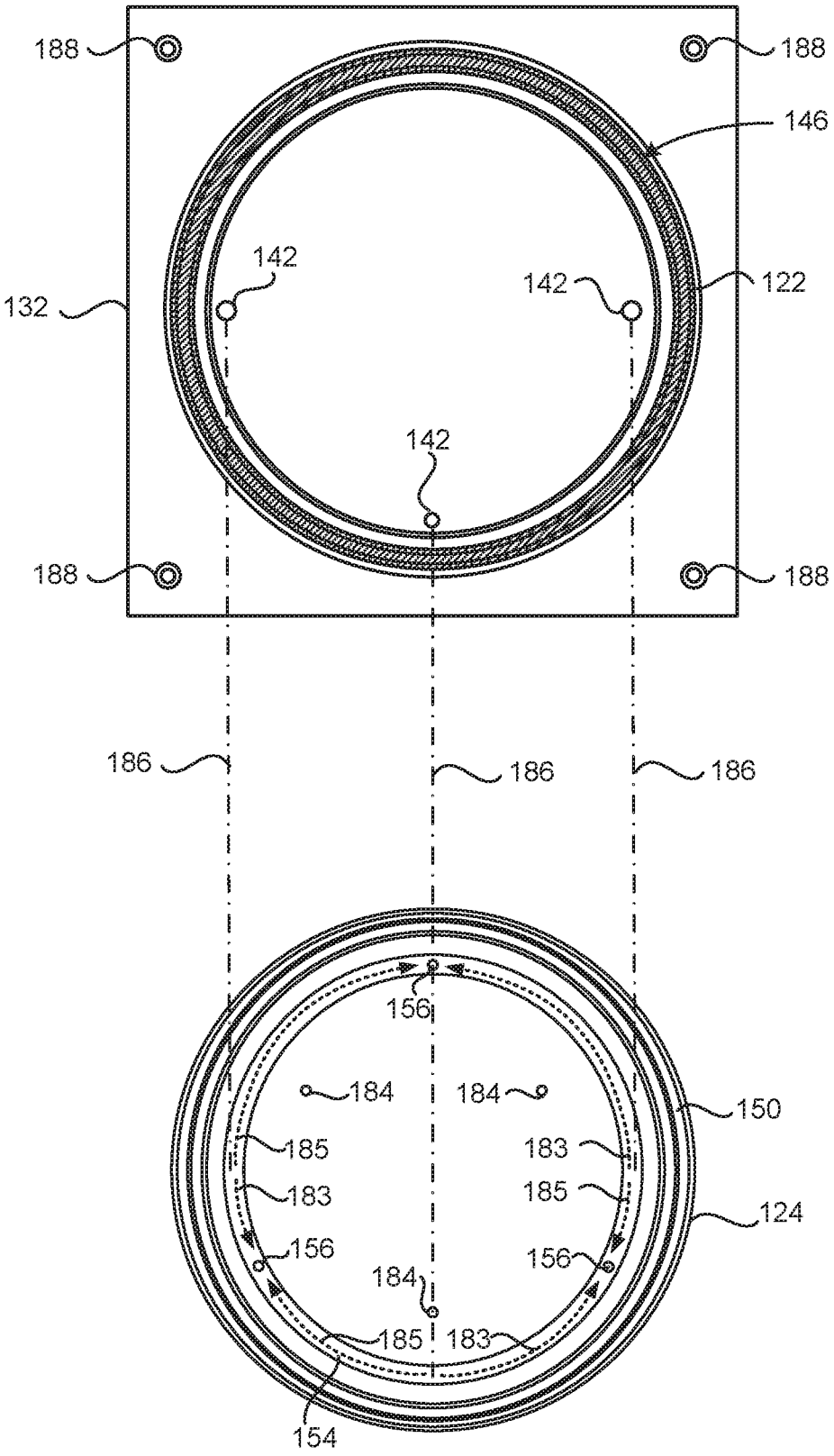
FIG. 5 illustrates an exploded assembly view showing alignment of the underside of the lid plate with a top side of the forming die of the machine according to various aspects.
Figure 13:
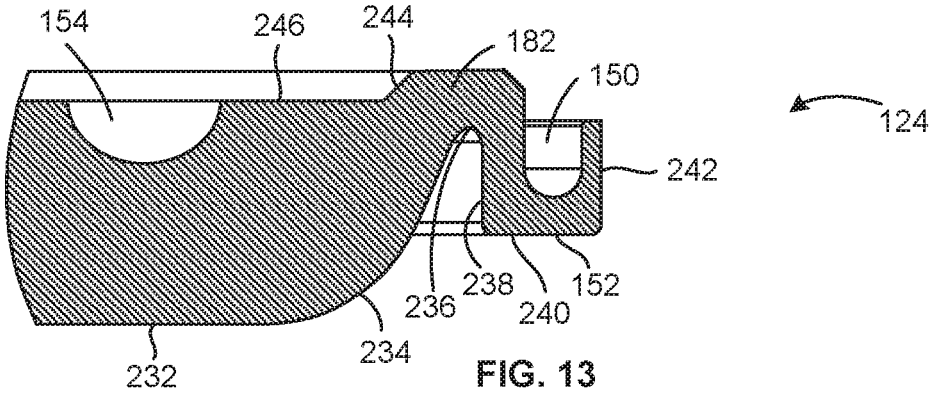
FIG. 13 is a detail view of a portion of the forming die shown in FIG. 2 according to various aspects.

Other features are also identified in FIG. 4 that are identified elsewhere herein, such as in FIGS. 2, 5, and 13. For example, FIG. 4 shows a ridge 182 and rim 242 each adjacent to the coupling groove 150 on opposite sides. In operation, the ridge 182 can at least partially engage the groove 146 of the pressure lid 120 for engaging together.

FIG. 5 illustrates an exploded assembly view showing alignment of the underside of the lid plate 132 with a top side of the forming die 124. In FIG. 5, the ring 122 is shown received in the groove 146 of the lid plate 132. The forming die 124 is shown positioned so that the coupling groove 150 on the top side of the forming die 124 is aligned to be received on the ring 122 on the bottom side of the lid plate 132.

FIG. 5 also shows the fluid ports 142 on the lid plate 132 in an orientation aligned with the channel 154 of the forming die 124. The fluid ports 142 can be aligned over the channel 154 (e.g., as illustrated by alignment reference lines 186) so as to be offset from the outlets 156 from the channel 154. For example, when the forming die 124 is installed relative to the lid plate 132, such offset alignment can cause fluid to pass through the fluid ports 142 (e.g., from the fittings 144 shown in FIG. 2), collect in the channel 154 (e.g., filling the channel 154), travel along the channel 154 (e.g., fluid received along each respective alignment reference lines 186 from each respective fluid port 142 can be distributed so that some portion of the liquid travels through the channel 154 toward a nearest outlet 156 in the counterclockwise direction in FIG. 5 as illustrated by arrows 183 and so that some other portion of the liquid travels through the channel 154 toward a nearest outlet 156 in the clockwise direction in FIG. 5 as illustrated by arrows 185), and exit through respective outlets 156 of the channel 154. Routing the fluid through the channel 154 then through outlets 156 that are offset from the fluid ports 142 rather than directly aligning with the fluid ports 142 can allow pressure from the fluid to be distributed rather than concentrated when introduced through the forming die 124.

FIG. 5 also shows guide sockets 188 on an underside of the lid plate 132. The guide sockets 188 can correspond to suitable features for receiving the guide shafts 148. For example, the sockets 188 can be threaded to match or mate with threads on the upper end 262 (FIG. 15) of the guide shaft 148 to secure the guide shaft 148 to the lid plate 132.

Figure 6:
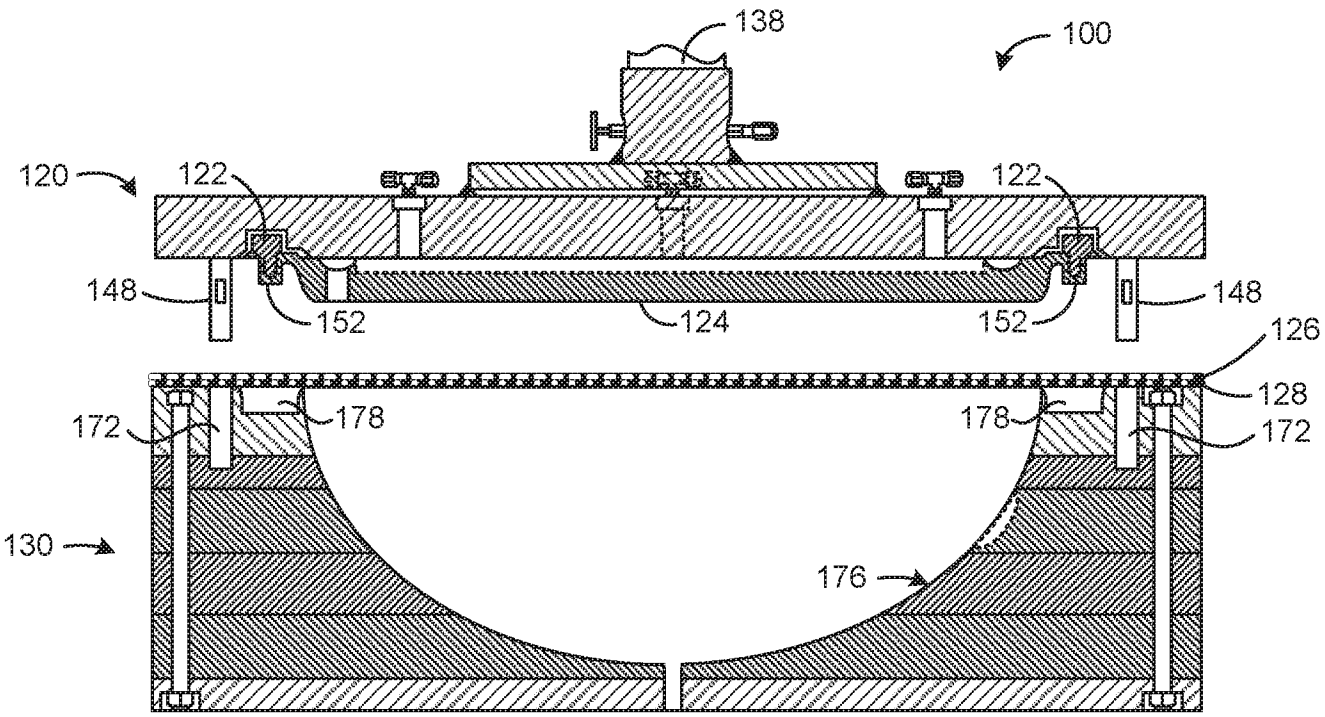
FIG. 6 is a side assembly view showing the machine assembled and aligned for operation according to various aspects.

FIG. 6 is a side assembly view showing the machine 100 assembled and aligned for operation according to various aspects. In FIG. 6, the forming die 124 is secured to the pressure lid 120 via the ring 122. The guide shafts 148 are aligned for insertion into the guide passages 172. Aligning the guide shafts 148 with the guide passages 172 can align other features. For example, in FIG. 6, the protrusion 152 of the forming die 124 is aligned for insertion into the face groove 178 of the mold die assembly 130. Furthermore, the forming die 124 is aligned for insertion into the bowl profile formed by the curved surface 176 of the mold die assembly 130. FIG. 6 also shows the work piece 128 and diaphragm 126 positioned between the pressure lid 120 and the mold die assembly 130, e.g., with the work piece 128 supported on the mold die assembly 130 and the diaphragm 126 atop the work piece 128.

Figure 7:
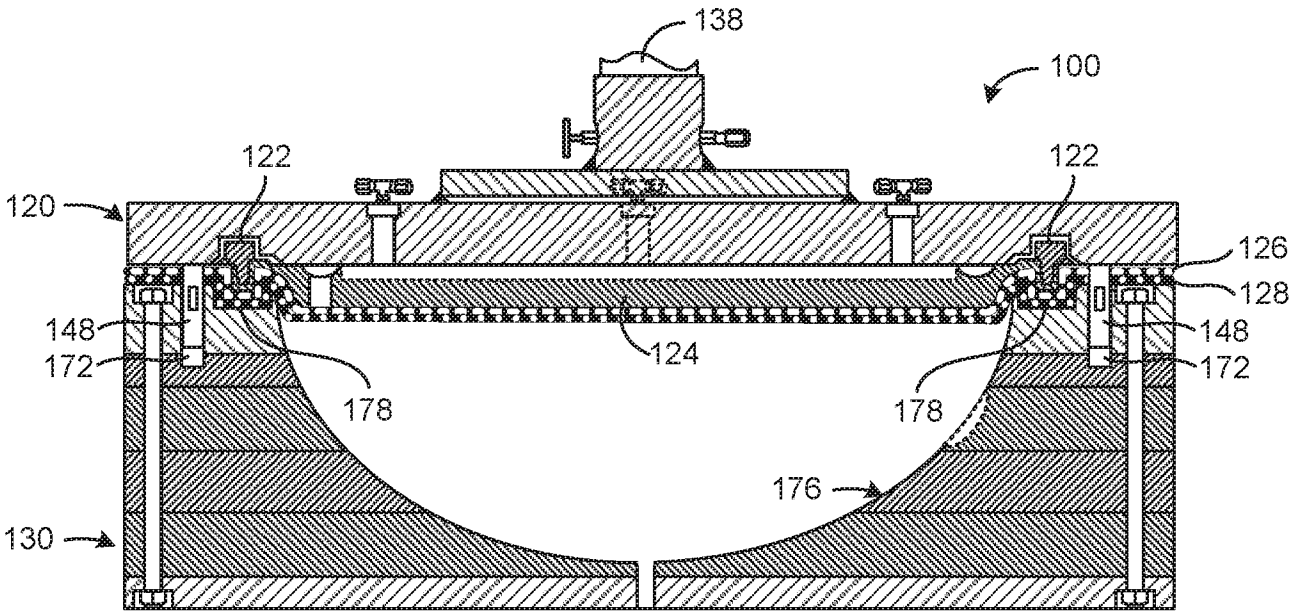
FIG. 7 is a side assembly view showing the machine with the pressure lid in engagement with the mold die assembly according to various aspects.

FIG. 7 is a side assembly view showing the machine 100 with the pressure lid 120 in engagement with the mold die assembly 130 according to various aspects. In operation, the pressure lid 120 can be moved into engagement with the mold die assembly 130 (e.g., from the position shown in FIG. 6 to the position shown in FIG. 7). For example, the pressure lid 120 can be moved by the hydraulic press ram 138. The guide shafts 148 can move into engagement with the guide passages 172 as the pressure lid 120 moves relative to the mold die assembly 130 and maintain alignment of other features of the machine 100. In FIG. 7, the guide shafts 148 are also shown passing through respective passages in the work piece 128 and the diaphragm 126. However, either or both of the work piece 128 and the diaphragm 126 can alternatively be sized to fit within an area bounded by the guide shafts 148, e.g., such that either or both of the work piece 128 and the diaphragm 126 are not penetrated by the guide shafts 148 in operation.

Relative movement of the pressure lid 120 and the mold die assembly 130 toward one another (e.g., from the position shown in FIG. 6 to the position shown in FIG. 7) can partially shape the work piece 128. For example, movement may cause the forming die 124 to exert force on the work piece 128 and cause deformation of the work piece 128. In FIG. 7, the work piece 128 is shown pressed by the forming die 124 so that the work piece 128 matches at least part of the forming die 124. For example, the forming die 124 can include a portion that corresponds in shape to a truncated segment of a dome to apply an initial pre-formed shape to the work piece 128. The pre-formed shape of the work piece 128 can facilitate subsequent stretching of the work piece toward the bowl profile formed by the curved surface 176 of the mold die assembly 130. The diaphragm 126 is also shown pressed by the forming die 124 into a state partially deflected toward the curved surface 176.

Engagement of the pressure lid 120 and the mold die assembly 130 with one another can seal components within the machine 100. For example, movement of the pressure lid 120 and the mold die assembly 130 toward one another (e.g., from the position shown in FIG. 6 to the position shown in FIG. 7) can cause the ring 122 to press components into the face groove 178 of the mold die assembly 130 to provide a seal. In FIG. 7, the work piece 128 and the diaphragm 126 are each shown pressed into the face groove 178 by a sufficient amount and with sufficient force to prevent passage of water or other fluid by the ring 122. However, although description herein primarily discusses inclusion of the diaphragm 126, in some aspects, the diaphragm 126 can be omitted (e.g., adequate sealing in various aspects may be accomplished by other components captured between the pressure lid 120 and the mold die assembly 130).

Figure 8:
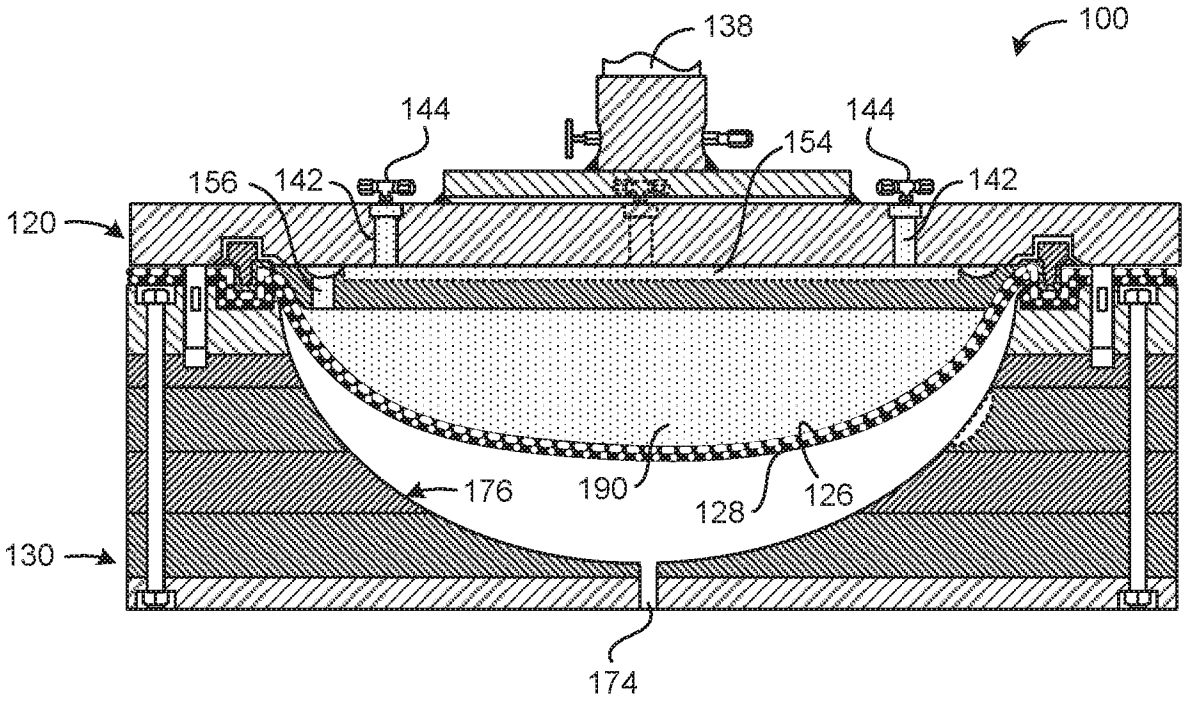
FIG. 8 is a side assembly view showing the work piece partially formed by hydraulic pressure provided by the machine according to various aspects.

FIG. 8 is a side assembly view showing the work piece 128 partially formed by hydraulic pressure provided by the machine 100 according to various aspects. In operation, water or other fluid 190 can be introduced through the fittings 144 to provide hydraulic pressure for the machine 100. The fluid 190 can travel through the fittings 144, fluid ports 142, channel 154, and outlets 156 to exert fluid pressure against the work piece 128 (e.g., via the diaphragm 126). The pressure of the fluid 190 can cause deformation of the work piece 128 toward the curved surface 176 of the mold die assembly 130. As the work piece 128 stretches under the influence of the fluid 190, air or other fluid that might otherwise become trapped between the work piece 128 and the curved surface 176 of the mold die assembly 130 can be vented out through the drain passage 174. Thus, the drain passage 174 may prevent a pressure build-up that could otherwise oppose the pressure being exerted by the fluid 190 introduced into the machine 100.

In operation, the pressure lid 120 may withstand pressure from the fluid 190. For example, the hydraulic press ram 138 may exert force against the lid 120 to maintain the lid 120 in contact with the mold die assembly 130 and prevent the lid 120 from being pushed out of engagement with the mold die assembly 130 by forces exerted by the fluid 190. The machine 100 may additionally or alternatively include clamps or other latches in addition to or in lieu of the hydraulic press ram 138 to maintain the lid 120 in engagement with the mold die assembly 130.

Figure 9:
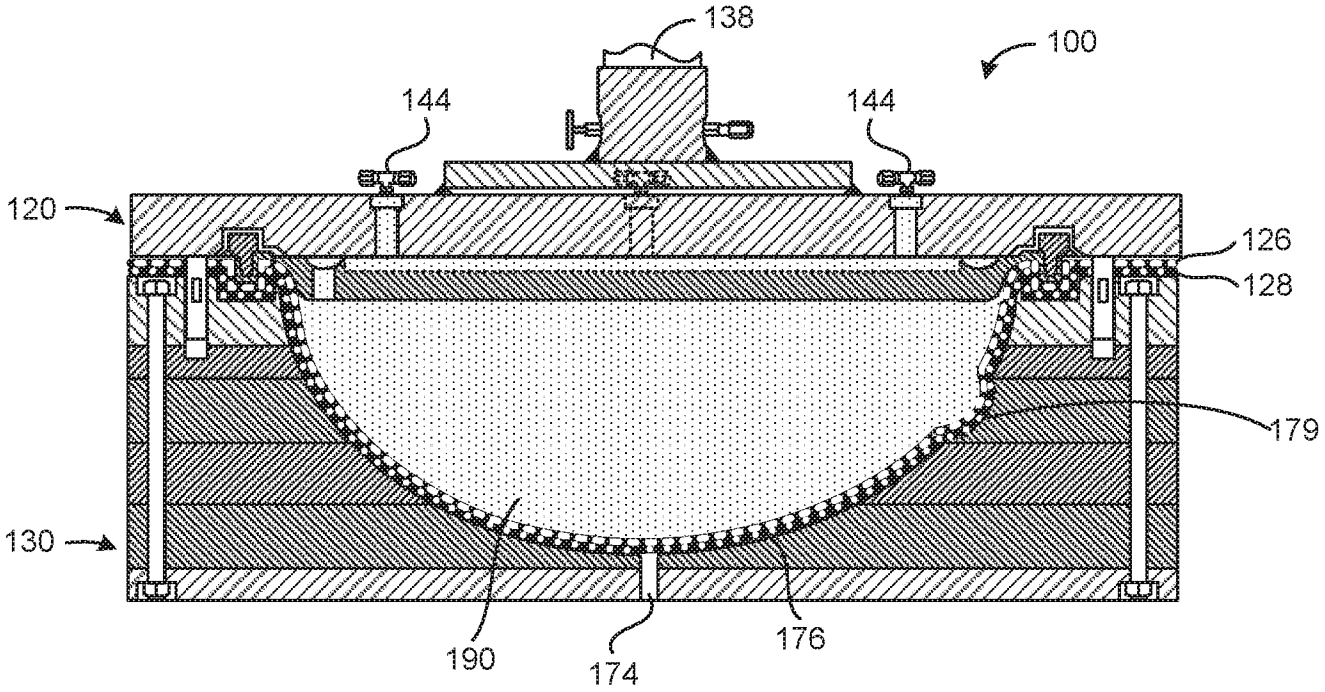
FIG. 9 is a side assembly view showing the work piece fully formed by hydraulic pressure provided by the machine according to various aspects.

FIG. 9 is a side assembly view showing the work piece 128 fully formed by hydraulic pressure provided by the machine 100 according to various aspects. In operation, fluid 190 may continue to exert pressure on the work piece 128 until the work piece 128 stretches out to press against and conform to the bowl profile formed by the curved surface 176 of the mold die assembly 130. In aspects in which an indentation 179 is included in the bowl profile formed by the curved surface 176, the work piece 128 can be stretched to press into the indentation 179 for forming a note region 112 (FIG. 1) of a steel pan instrument 106. Although only one indentation 179 is shown in FIG. 9, any suitable number of indentations 179 can be included in any suitable variety of sizes and locations for forming appropriate patterns of note regions 112. Moreover, although the indentation 179 is shown arranged to impart a concave shape when viewed from inside the bowl of the work piece 128, the indentation 179 may be arranged to additionally or alternatively impart a convex shape or other contour.

Pressure can be bled off through the fittings 144 to de-pressurize the contents of the machine 100, and the pressure lid 120 can be removed from the mold die assembly 130 (e.g., via operation of the hydraulic press ram 138) to expose the formed work piece 128. Any remaining fluid 190 in the work piece 128 can be emptied (e.g., by upending the work piece 128 to cause the fluid to drain out through the drain passage 174). The formed work piece 128 can be plastically or permanently deformed to hold the shape formed by pressing against the curved surface 176 of the mold die assembly 130. The diaphragm 126 may be elastically deformed by the fluid 190 such that cessation of pressure from the fluid 190 will cause the diaphragm 126 to return to its original shape and be suitable for re-use for subsequent forming operations. The formed work piece 128 (and diaphragm 126 if present) can be removed to provide space for inserting a new work piece 128 to repeat the process.

In some aspects, the machine 100 may be operated with a different combination of components than already described. For example, in some examples, the machine 100 may be readily configurable to form work pieces 128 of different sizes for different sizes of steel pan instruments 106. In some aspects, work pieces 128 of different sizes may be formed by swapping between different variations of the mold die assembly 130, e.g., which may include different bowl profiles. In some aspects, work pieces 128 of different sizes may be formed by swapping between different variations of the pressure lid 120. For example, some variations of the pressure lid 120 may be utilized without use of the forming die 124 or with a different size of forming die 124. An illustrative example of an alternate configuration of the machine 100 is described below with respect to FIG. 10.

Figure 10:
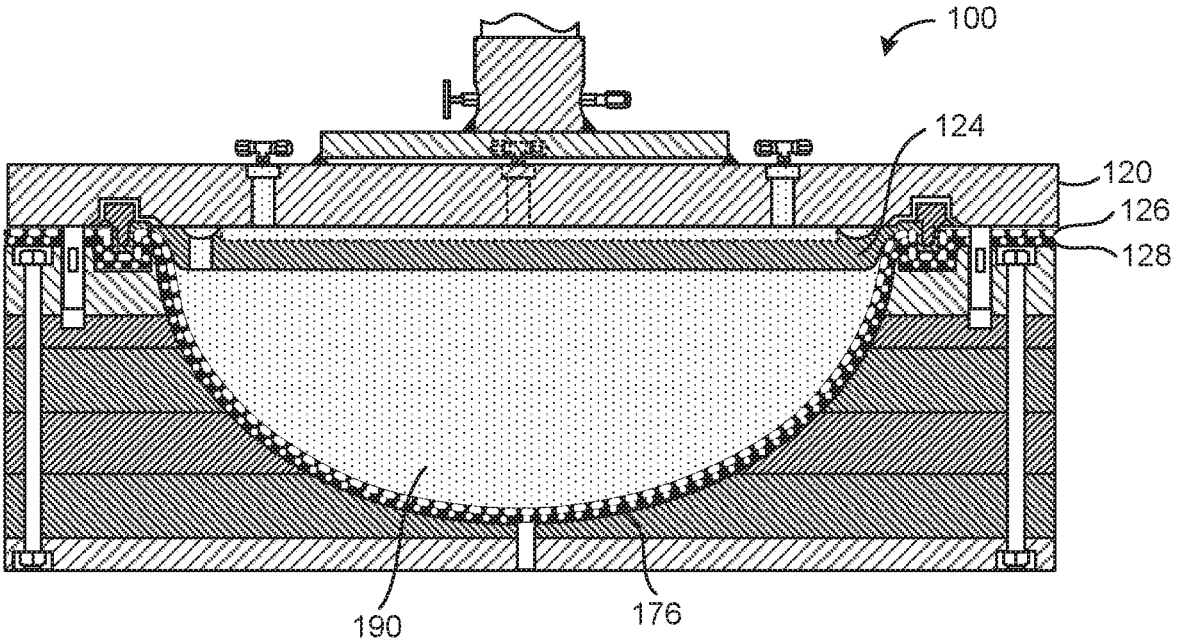
FIG. 10 illustrates a side assembly view showing a pair of machines configured differently to form work pieces for different sizes of steelpan instrument according to various aspects.
Figure 10:
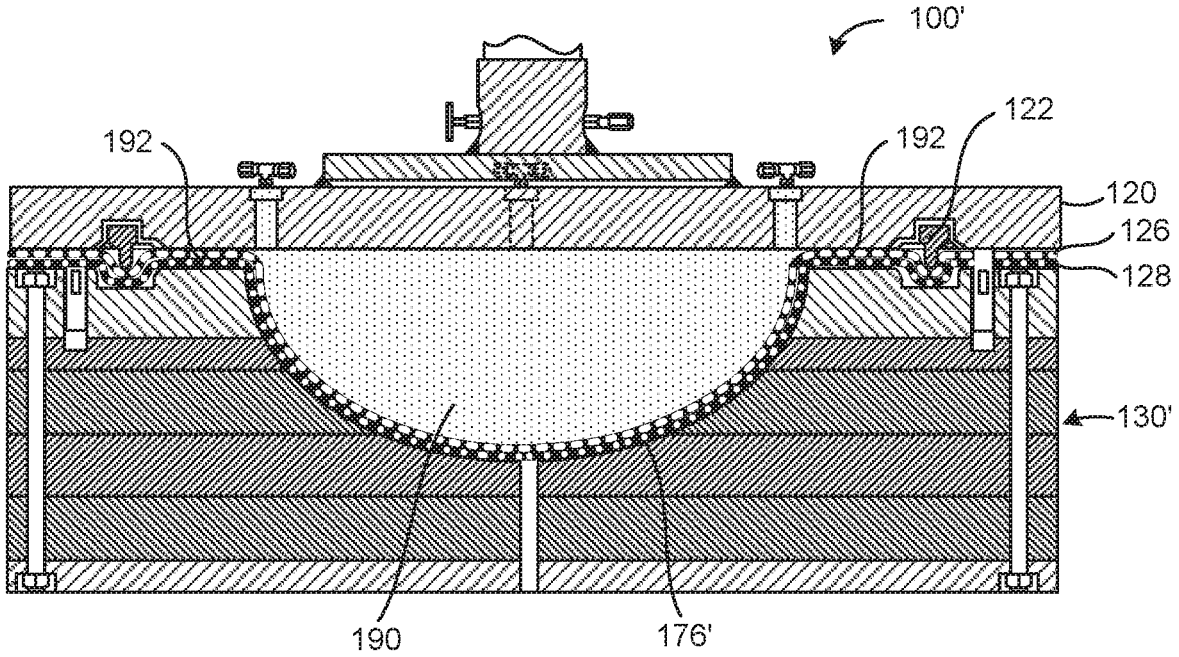

FIG. 10 illustrates a side assembly view showing a pair of machines 100 and 100' configured differently to form work pieces 128 and 128' for different sizes of a steelpan instrument 106. The first machine 100 at top in FIG. 10 ("top machine 100") is substantially the same as shown in FIG. 9 (apart from the curved surface 176 in FIG. 10 being shown without the indentation 179 shown in FIG. 9). The second machine 100' at bottom in FIG. 10 ("bottom machine 100'") differs in that it does not include a forming die 124 and includes a modified mold die assembly 130'. In contrast to the mold die assembly 130 of the top machine 100, the modified mold die assembly 130' of the bottom machine 100' defines a modified curved surface 176' that defines a smaller bowl profile than that defined in the mold die assembly 130 of the top machine 100. In an illustrative example, the top machine 100 can be used in production of steel pan instruments 106 that are approximately 24 inches (about 61 cm) across, while the bottom machine 100' can be used in production of steel pan instruments 106 that are approximately 10 inches (about 25 cm) across. As may be appreciated with reference to FIG. 10, in some aspects, a work piece 128' that is to be formed into a smaller bowl can be secured by the machine 100' in the absence of a forming die 124. In various of such aspects, the ring 122 can function to seal fluid 190 within the machine 100' without additional clamping effect provided by the forming die 124. Thus, in various aspects, the machine 100 may be reconfigured to correspond to the machine 100' by merely removing the forming die 124 from the pressure lid 120 and substituting a different modified mold die assembly 130'. In some aspects, a seal provided by the machine 100' may be supplemented by sandwiched portions 192 that correspond to portions of the diaphragm 126 and/or the work piece 128 that are located between the ring 122 and the curved surface 176' and captured between the pressure lid 120 and the mold die assembly 130.

FIGS. 11-15 are detail views of features depicted in FIG. 2. Although examples of particular contours and relative sizing of features are described with reference to FIGS. 11-15, the machine 100 is not limited to these particular arrangements and may additionally or alternatively include any other suitable features for achieving equivalent function.

Figure 11:
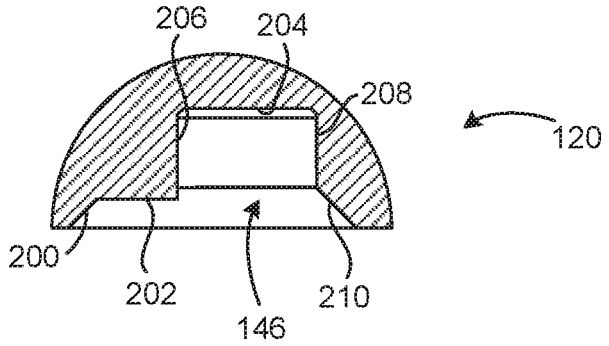
FIG. 11 is a detail view of the groove in the pressure lid shown in FIG. 2 according to various aspects.

FIG. 11 is a detail view of the groove 146 in the pressure lid 120 shown in FIG. 2. The groove 146 as depicted in FIG. 11 is bounded within the pressure lid 120 by a first ramp 200, a ledge 202, a first sidewall 206, an inner wall 204, a second sidewall 208, and a second ramp 210. The inner wall 204 faces the exterior of the groove 146 and is bounded by the first sidewall 206 and the second sidewall 208, which each extend away from the inner wall 204 (e.g., perpendicularly). The ledge 202 extends away from the first sidewall 206 (e.g., perpendicularly) and terminates in the first ramp 200. The first ramp 200 and second ramp 210 are positioned at outer edges of the groove 146 and provide sloped surfaces along which other features may slide into and/or out of the groove 146. The groove 146 can be circumferentially arranged and/or annular.

Figure 12:
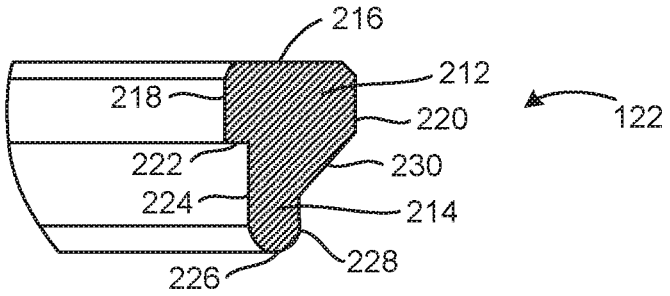
FIG. 12 is a detail view of the ring shown in FIG. 2 according to various aspects.

FIG. 12 is a detail view of the ring 122 shown in FIG. 2. The ring 122 as depicted in FIG. 12 includes an upper section 212 and a lower lobe 214. The upper section 212 includes an upper wall 216 from which a first sidewall 218 and a second sidewall 220 extend (e.g., perpendicularly). A shoulder 222 extends from the first sidewall 218 (e.g., perpendicularly) and inwardly toward an opposite side of the upper section 212. A recessed side wall 224 extends from the shoulder 222 (e.g., perpendicularly) and toward a bottom end 226 of the lobe 214. The shoulder 222 and the recessed wall 224 can provide a stepped transition between the upper section 212 and the lower lobe 214. The bottom end 226 of the lobe 214 can correspond to an extremity of a curved surface 228 of the lower lobe 214. A slanted surface 230 can extend from the second sidewall 220 inwardly toward an opposite side of the ring 122 and provide an angled transition between the lower lobe 214 and the upper section 212. The ring 122 can be circumferentially arranged and/or annular.

In use, the ring 122 of FIG. 12 can be received in the groove 146 of FIG. 11. For example, the first sidewall 218, upper wall 216, and second sidewall 220 of the ring 122 can be sized and shaped to respectively engage and interfere with the first sidewall 206, inner wall 204, and second sidewall 208 of the groove 146.

FIG. 13 is a detail view of a portion of the forming die 124 shown in FIG. 2. The forming die 124 as depicted in FIG. 13 includes a main body 232 connected by the ridge 182 to the protrusion 152. The main body 232 includes a curved section 234 (e.g., which can correspond in shape to a truncated dome). A pocket 236 is formed on an underside of the ridge 182 and forms a transition between the main body 232 and the protrusion 152. A lower perimeter of the protrusion 152 is formed by an inner sidewall 238, a lower wall 240, and a rim 242. The inner sidewall 238 and the rim 242 each extend away from the lower wall 240 (e.g., perpendicularly). The pocket 236 is positioned between the curved section 234 and the inner sidewall 238 of the protrusion 152. The coupling groove 150 is formed on an upper side of the protrusion 152 and is bounded by the rim 242 and the ridge 182. An inclined surface 244 provides a transition between the ridge 182 and the main body 232 on an upper side of the main body 232. An upper surface 246 of the main body 232 may be recessed back along the inclined surface 244 from an uppermost portion of the ridge 182. The channel 154 is formed in the upper surface 246 of the main body 232 of the forming die 124. The forming die 124 can be circumferentially arranged and/or annular.

In use, the forming die 124 of FIG. 13 can be received on the ring 122 of FIG. 12 and/or in the groove 146 of FIG. 11. For example, the coupling groove 150 in the upper side of the protrusion 152 of the forming die 124 can be sized and shaped to respectively engage and interfere with the lobe 214 of the ring 122 of FIG. 12. Moreover, the ridge 182 and inclined surface 244 can be sized and shaped to respectively fit against the ledge 202 and the first ramp 200 of the groove 146 of FIG. 11, such as when the ring 122 is received into the groove 146 and the forming die 124 is received on the ring 122. For example, the ledge 202 (FIG. 11), the shoulder 222 (FIG. 12), and the upper face of the ridge 182 (FIG. 13) may all be aligned along a common plane when assembled together.

Figure 14:
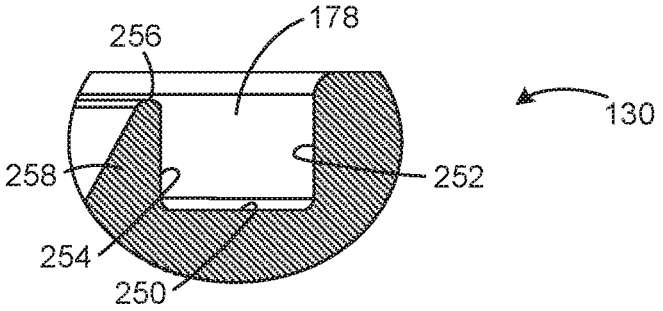
FIG. 14 is a detail view of the face groove in the mold die assembly shown in FIG. 2 according to various aspects.

FIG. 14 is a detail view of the face groove 178 in the mold die assembly 130 shown in FIG. 2. The face groove 178 as depicted in FIG. 14 is bounded by an inner wall 250, a first sidewall 252, and a second sidewall 254. The first sidewall 252 and the second sidewall 254 extend away from the inner wall 250 (e.g., perpendicularly). The second sidewall 254 terminates in a lip 256 that provides a transition to a curved surface 258. The curved surface 258 can form a portion of the curved surface 176 that forms the bowl profile of the mold die assembly 130. The face groove 178 can be circumferentially arranged and/or annular.

In use, the face groove 178 of FIG. 14 can receive the protrusion 152 of the forming die 124 of FIG. 13. In various aspects, the inner wall 250, the first sidewall 252, and the second sidewall 254 of the face groove 178 in the upper side of the mold die assembly 130 can be sized and shaped to provide space for insertion of the inner side wall 238, lower wall 240, and rim 242 of the protrusion 152 of the forming die 124 of FIG. 12 along with any intervening material (such as the diaphragm 126 and/or the work piece 128). Moreover, the lip 256 (FIG. 14) can be sized to facilitate being received within the pocket 236 (FIG. 13) along with any intervening material (such as the diaphragm 126 and/or the work piece 128).

FIG. 15 is a detail view showing an example in isolation of the guide shaft 148 shown in FIG. 2. The guide shaft 148 as depicted in FIG. 15 includes a lower segment 260 and an upper end 262. Installation features 189 are shown formed in the lower segment 260 as flat surfaces for receiving a wrench for facilitating twisting for installing threads on the upper end 262 relative to guide sockets 188 (FIG. 5).

Figure 16:
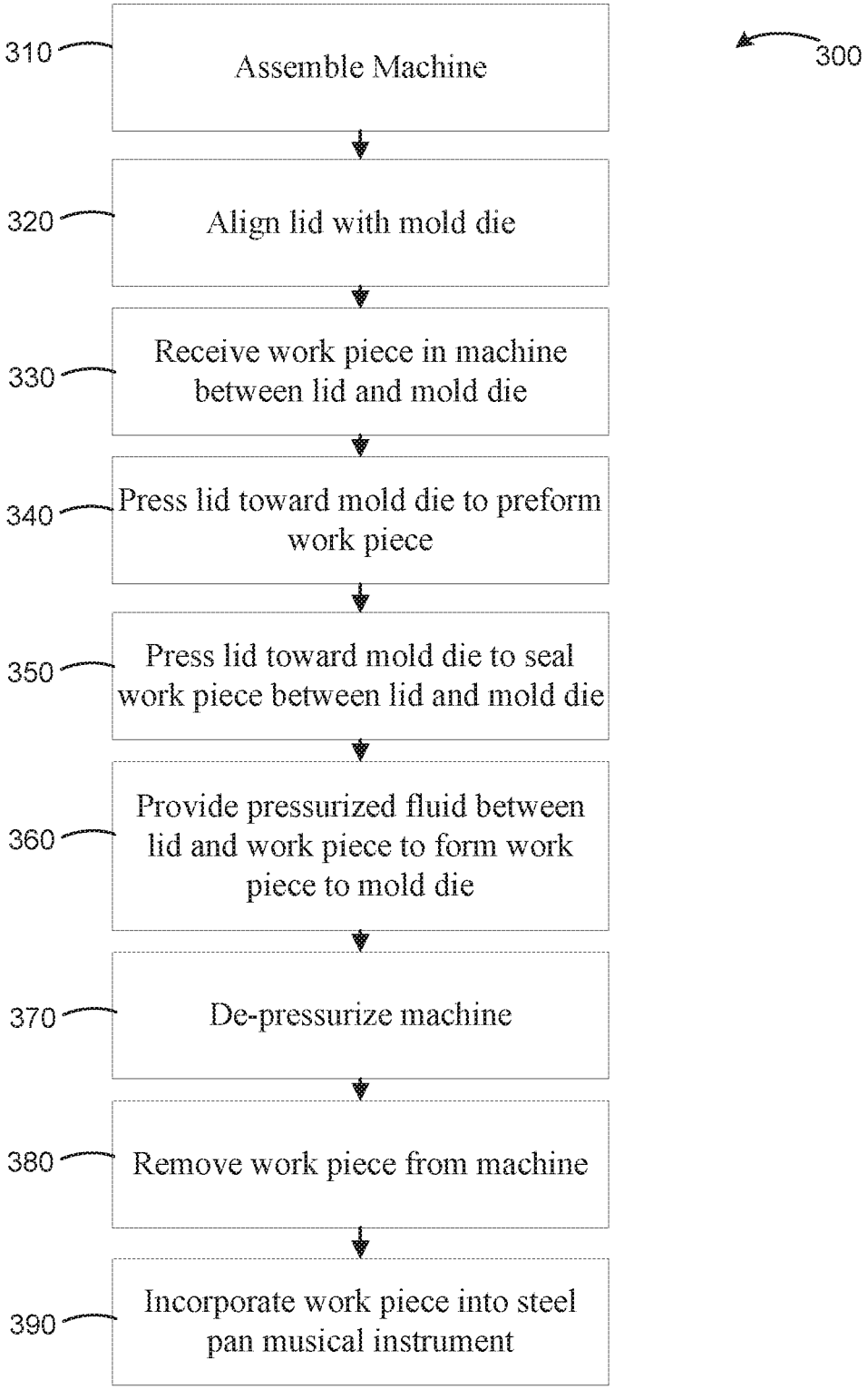
FIG. 16 is a flow chart illustrating an example process for forming a steel pan instrument with the machine according to various aspects.

FIG. 16 is a flow chart illustrating an example process 300 for forming a steel pan instrument with the machine according to various aspects.

The process 300 at operation 310 can include assembling a machine. The machine, for example, can correspond to the machine 100 described herein.

The operation 310 can include assembling components of the pressure lid 120. For example, the operation 310 can include mounting the forming ring 122 to the pressure lid 120, such as by inserting the forming ring 122 into the groove 146 of the pressure lid 120 and/or use of any other attachment method. As another example, the operation 310 can include mounting the forming die 124 to the pressure lid 120, such as by connecting the forming die 124 to the ring 122, inserting a part of the forming die 124 into the groove 146 of the pressure lid 120, coupling the forming die 124 with fasteners through fastener apertures 184, or any combination of these or other attachment methods. In some aspects, the operation 310 may include selecting between assembling components to leave the ring 122 exposed from the pressure lid 120 or to leave the forming die 124 exposed from the pressure lid 120, for example, to facilitate production of different sizes of steel pan instrument 106 such as described with reference to FIG. 10. In some aspects, the operation at 310 can include coupling the pressure lid 120 with other components, such as with the hydraulic press ram 138 (e.g., via the press collar 136) or with hoses or other conduits to provide water or other pressurized fluid (e.g., via the fittings 144).

The operation 310 can include assembling components of a mold die. The mold die, for example, can correspond to the mold die assembly 130 described herein. For example, the operation 310 can include stacking one or more spacer plates 160 on a base plate 158, topping the stack with a cap plate 162, and securing the stack together (e.g., via rods 164 secured by nuts 166 or other fasteners and positioned inserted with or without sleeves 180 through rod passages 170 that extend through respective layers of the stack). In some aspects, the operation 310 may include selecting between different options for the mold die, for example, to facilitate production of different sizes of steel pan instrument 106 such as described with reference to FIG. 10. For example, the operation 310 may include selecting among differently contoured layers to produce a bowl profile of a particular size and/or shape for a particular model or type of steel pan instrument 106.

The process 300 at operation 320 can include aligning the pressure lid with the mold die. For example, the operation 320 can include aligning the forming ring 122 and/or the forming die 124 of the pressure lid 120 for insertion relative to the curved surface 176 and/or face groove 178 of the mold die assembly 130. Additionally or alternatively, the operation 320 can include aligning the guide shafts 148 for insertion relative to the guide passages 172. For example, tips of the guide shafts 148 can be inserted into the guide passages 172 so that further movement of the pressure lid 120 relative to the mold die assembly 130 can be constrained by travel of the guide shafts 148 in the guide passages 172 to maintain relative alignment of other features of the pressure lid 120 with the mold die assembly 130.

The process 300 at operation 330 can include receiving a work piece in the machine between the lid and the mold die. For example, the operation 330 can include placing a blank 102 or work piece 128 on the mold die assembly 130, such as on the cap plate 162 or in an indentation formed therein for holding in place. In some aspects, the blank 102 or work piece 128 can further be lubricated (e.g., with mineral or vegetable oil) before being received in the machine 100. In some aspects, the operation 330 can also include receiving a diaphragm 126 on and/or over the work piece 128. In some aspects, the operation 330 can be performed before operation 320.

The process 300 at operation 340 can include pressing the lid toward the mold die to preform the work piece. For example, the operation 340 can include pressing the forming die 124 into the work piece 128 to impart a truncated dome or frustoconical shape to a portion of the work piece 128 located near an upper section of the curved surface 176 of the bowl profile of the mold die assembly 130 and/or near the face groove 178 of the mold die assembly 130. As an illustrative example, the operation 340 may include operating a 100 ton single action hydraulic press at 55 tons to exert a force through the ram 138 on the pressure lid 120 for preforming the work piece 128.

The process 300 at operation 350 can include pressing the lid toward the mold die to seal the work piece between the lid and the mold die. For example, the operation 350 can include pressing the forming die 124 and/or the forming ring 122 into the work piece 128 and/or into the diaphragm 126 to cause sealing engagement in the face groove 178 of the mold die assembly 130. In some aspects, the operation 340 and the operation 350 may be accomplished by a single process. As an illustrative example, the operation 340 may include operating a 100 ton single action hydraulic press at 55 tons to exert a force through the ram 138 on the pressure lid 120 for sealing the work piece 128 between the pressure lid 120 and mold die assembly 130 by forcing a portion of the work piece 128 into the face groove 178 of the mold die assembly 130. In some aspects, the operation 350 can be performed independent of the operation 340. As an illustrative example, the operation 340 may be omitted (e.g., based on omitting the forming die 124 and proceeding solely with the forming ring 122), and the operation at 350 may be performed by a hydraulic press, by clamps about the pressure lid 120 and the mold die assembly 130, or by any other structure capable of pressing and/or holding the pressure lid 120 and the mold die assembly 130 together in sealing engagement. In various aspects, the operation 350 may be continued during other operations of the process 300, such as to maintain the pressure lid 120 and the mold die assembly 130 in sealed engagement during such other operations. As an illustrative example, the pressure lid 120 and the mold die assembly 130 may be maintained in sealed engagement by ongoing operation of the hydraulic press (such as holding at 55 tons) or by clamps to counteract forces that may be exerted on the pressure lid 120 and/or other components of the machine 100 during operations 350 and 370 described below.

The process 300 at operation 360 can include providing pressurized fluid between the lid and the work piece to form the work piece to the mold die. For example, the operation 360 can include introducing fluid 190 through the fittings 144 to exert fluid pressure against the work piece 128 (e.g., via the diaphragm 126, if present) to form the work piece 128 to the mold die assembly 130 (such as to cause the work piece 128 to adopt the shape of the curved surface 176 and indentations 179, if present). In an illustrative example, the fluid 190 can be pressurized to 1500 PSI and that pressure can be held for a suitable amount of time (e.g., 15 seconds) to provide sufficient pressure to deform the work piece 128 into a shape conforming to the mold die assembly 130. In some aspects, progress of the forming may be detectable via observation through the drain passage 174 in addition to or in lieu of imparting a threshold pressure for a pre-determined amount of time. For example, if a threshold pressure such as 1500 PSI is not obtained, pressurizing can be continued until it is confirmed through observation through the drain passage 174 that the work piece 128 has been sufficiently deformed to adopt the shape of the mold die assembly 130.

In some aspects, providing pressurized fluid in the operation 360 can include expelling air that might otherwise be present in the machine 100 when initiating pressurization. For example, at least one of the fittings 144 can function or be operated as a relief valve. The relief valve can be maintained in an open condition to allow venting of air as water or other fluid is initially introduced through another fitting 144 to initiate pressurization. When water or other fluid introduced through another fitting exits through the relief valve, this may indicate that all air has been vacated and that the relief valve can be closed to facilitate increasing the pressure of the water or other fluid.

The process 300 at operation 370 can include de-pressurizing the machine. For example, the operation 370 can include bleeding off pressure through one or more of the fittings 144. The operation 370 can also include separating the pressure lid 120 from the mold die assembly 130, such as by pulling the pressure lid 120 away by force of the hydraulic press ram 138.

The process 300 at operation 380 can include removing the work piece from the machine. For example, the operation 380 can include extracting the work piece 128 from the face groove 178 of the mold die assembly 130 following separation of the pressure lid 120 from the mold die assembly 130.

The process 300 at operation 380 can include incorporating the work piece into a steel pan musical instrument. For example, the operation 380 can include tuning the work piece 128, such as by hand hammering to make indentations to form note regions 112 or checking and/or correcting note regions 112 introduced by the machine 100 via indentations 179 if present in the mold die assembly 130. As further examples, the operation 380 can include coupling the work piece 128 to a suitable skirt 108 and/or stand 110, such as by welding or any other suitable coupling method.

Other variations are within the spirit of the present disclosure. Thus, while the disclosed aspects are susceptible to various modifications and alternative constructions, certain illustrated embodiments thereof are shown in the drawings and have been described above in detail. It should be understood, however, that there is no intention to limit the disclosure to the specific form or forms disclosed, but on the contrary, the intention is to cover all modifications, alternative constructions and equivalents falling within the spirit and scope of the disclosure, as defined in the appended claims.

The use of the terms "a" and "an" and "the" and similar referents in the context of describing the disclosed embodiments (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the disclosure and does not pose a limitation on the scope of the disclosure unless otherwise claimed. No language in the specification should be construed as indicating any non-claimed element as essential to the practice of the disclosure.

Disjunctive language such as the phrase "at least one of X, Y, or Z," unless specifically stated otherwise, is intended to be understood within the context as used in general to present that an item, term, etc., can be either X, Y, or Z, or any combination thereof (e.g., X, Y, and/or Z). Thus, such disjunctive language is not generally intended to, and should not, imply that certain embodiments or aspects require at least one of X, at least one of Y, or at least one of Z to each be present.

Preferred embodiments of this disclosure are described herein, including the best mode known to the inventors for carrying out the disclosure. Variations of those preferred embodiments can become apparent to those of ordinary skill in the art upon reading the foregoing description. The inventors expect skilled artisans to employ such variations as appropriate and the inventors intend for the disclosure to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

All references, including publications, patent applications and patents, cited herein are hereby incorporated by reference to the same extent as if each reference were individually and specifically indicated to be incorporated by reference and were set forth in its entirety herein.

What is claimed is:

1. A method of forming a steel pan musical instrument, the method including:

providing a metal sheet as a work piece from which to form at least a portion of the steel pan instrument;

providing a pressure lid comprising (i) a press collar, (ii) a fluid passage extending through the pressure lid, (iii) a guide shaft extending from an underside of the pressure lid, and (iv) a groove formed in the underside of the pressure lid;

coupling the press collar of the pressure lid with a hydraulic press;

coupling the fluid passage of the pressure lid to a source of pressurized fluid;

installing a ring in the groove of the pressure lid;

installing a forming die onto the pressure lid by engaging the forming die with the ring, the forming die comprising (i) a main body having a partial dome shape and (ii) an outlet extending through the main body and in fluid communication with the fluid passage of the pressure lid when the forming die is installed on the pressure lid;

providing a mold die comprising (i) a face groove in an upper side, (ii) a bowl profile recessed from the upper side and positioned radially inward from the face groove, and (iii) a guide passage configured to receive the guide shaft of the pressure lid, wherein the providing the mold die comprises:

providing a base plate of the mold die;

providing at least one spacer plate of the mold die;

providing a cap plate of the mold die;

positioning the base plate, the at least one spacer plate, and the cap plate together into a stack such that the at least one spacer plate is positioned between the base plate and the cap plate; and coupling the base plate, the at least one spacer plate, and the cap plate together by extending rods through the stack and securing the rods to secure the stack together;

placing the work piece on the mold die;

placing a diaphragm on the work piece;

aligning the guide shaft of the pressure lid to travel within the guide passage of the mold die so as to maintain an alignment between the pressure lid and the mold die during movement of the pressure lid relative to the mold die;

operating the hydraulic press to push the pressure lid toward the mold die so that the forming die coupled with the pressure lid engages the diaphragm for pressing the work piece into sealing engagement with the face groove of the mold die and for imparting a shape of the forming die into the work piece;

hydroforming the work piece, wherein the hydroforming comprises:

introducing pressurized fluid through the fluid passage of the pressure lid and the outlet of the forming die to the diaphragm so as to exert fluid pressure through the diaphragm to the work piece; and in response to the fluid pressure exerted through the diaphragm to the work piece, causing the work piece to be pressed against the bowl profile of the mold die to form the work piece into a corresponding bowl shape;

operating the hydraulic press to separate the pressure lid from the mold die; and removing the work piece in the form of the bowl shape for incorporation into the steel pan musical instrument.

2. The method of claim 1, further comprising forming note regions in the work piece.

3. The method of claim 2, wherein the forming the note regions in the work piece comprises forming the note regions in the work piece by pressing the work piece into indentations in the bowl profile in response to the fluid pressure exerted through the diaphragm to the work piece.

4. The method of claim 2, wherein forming the note regions in the work piece comprises hand hammering the note regions.

5. The method of claim 1, wherein the introducing pressurized fluid through the fluid passage of the pressure lid and the outlet of the forming die to the diaphragm includes routing fluid from the fluid passage of the pressure lid into a channel formed in an upper side of the forming die and from the channel through the outlet.

6. The method of claim 1, wherein the steel pan musical instrument is a first steel pan musical instrument, the method further comprising:

removing the forming die from the pressure lid;

providing a second metal sheet as a second work piece from which to form at least a portion of a second steel pan musical instrument that is smaller than the first steel pan musical instrument;

providing a second mold die comprising (i) a second face groove in a top side, (ii) a second bowl profile recessed from the top side and positioned radially inward from the second face groove, and (iii) a second guide passage configured to receive the guide shaft of the pressure lid;

placing the second work piece on the second mold die;

placing the diaphragm on the second work piece; and operating the hydraulic press to push the pressure lid toward the second mold die so that the ring coupled with the pressure lid engages the diaphragm for pressing the second work piece into sealing engagement with the second face groove of the second mold die.

7. The method of claim 1, further comprising coupling a skirt with the work piece.

8. A machine for forming a work piece into a bowl subcomponent of a steel pan musical instrument, the machine comprising:

a pressure lid;

a mold die configured to receive the work piece between the mold die and the pressure lid, the mold die comprising:

a bowl profile;

a base plate including metal material;

a cap plate including metal material;

at least one spacer plate including non-metal material, the at least one spacer plate positioned between the base plate and the cap plate so as to form a stacked assembly that defines the bowl profile; and a face groove formed in an upper side of the mold die, wherein the bowl profile is recessed from the upper side and positioned radially inward from the face groove;

a fluid passage configured to couple with a source of pressurized fluid and arranged to introduce the pressurized fluid between the pressure lid and the work piece to exert a fluid pressure on the work piece for hydroforming in response to which the work piece is pressed against the bowl profile to be formed into the bowl subcomponent of the steel pan musical instrument;

a ring coupled with an underside of the pressure lid, the ring sized and arranged to press a portion of the work piece into the face groove of the mold die in response to pressure imparted to the pressure lid engaging the mold die so as to form a seal bounding an area of the work piece located interior to the ring such that fluid introduced through the fluid passage is prevented from passing the seal so as to exert the fluid pressure on the work piece for hydroforming; and a forming die comprising:

a main body having a partial dome shape and sized and arranged to impart a shape of the forming die into the work piece in response to pressure imparted to the pressure lid by a hydraulic press;

a protrusion at an edge of the main body and extending downward;

a coupling groove extending downward into an upper side of the protrusion, the coupling groove received on the ring for coupling the forming die with the pressure lid so that the ring presses through the protrusion of the forming die to press the portion of the work piece into the face groove; and an outlet extending through the main body and in fluid communication with the fluid passage of the pressure lid when the forming die is coupled with the pressure lid such that the fluid introduced from the source of pressurized fluid is introduced through the fluid passage and the outlet.

9. The machine of claim 8, wherein the base plate and the cap plate each include steel and the at least one spacer plate includes polyoxymethylene.

10. The machine of claim 8, wherein the fluid passage extends through the pressure lid.

11. The machine of claim 8, wherein the pressure lid further comprises at least one of:

a press collar configured for coupling the pressure lid with a hydraulic press; or a fitting configured for coupling the fluid passage to the source of pressurized fluid.

12. The machine of claim 8, wherein the ring is received in a groove formed in the underside of the pressure lid.

13. The machine of claim 8, wherein the forming die further comprises a channel formed in an upper side of the forming die and arranged to convey fluid between the fluid passage and the outlet of the forming die.

14. The machine of claim 8, further comprising:

a guide shaft extending from one of an underside of the pressure lid or an upper side of the mold die; and a guide passage positioned extending into an other of the underside of the pressure lid or the upper side of the mold die, the guide passage configured to receive the guide shaft so as to constrain movement between the pressure lid and the mold die to maintain an alignment of the pressure lid with the mold die.

* * * * *